US009869215B2

(12) United States Patent
Son et al.

(10) Patent No.: US 9,869,215 B2
(45) Date of Patent: Jan. 16, 2018

(54) CONTINUOUS VARIABLE VALVE DURATION APPARATUS AND ENGINE PROVIDED WITH THE SAME

(71) Applicant: Hyundai Motor Company, Seoul (KR)

(72) Inventors: You Sang Son, Suwon-si (KR); Kyoung Pyo Ha, Seongnam-si (KR); Back sik Kim, Osan-si (KR)

(73) Assignee: Hyundai Motor Company, Seoul (KR)

( * ) Notice: Subject to any disclaimer, the term of this patent is extended or adjusted under 35 U.S.C. 154(b) by 135 days.

(21) Appl. No.: 14/948,269

(22) Filed: Nov. 21, 2015

(65) Prior Publication Data

US 2016/0169066 A1 Jun. 16, 2016

(30) Foreign Application Priority Data

Dec. 10, 2014 (KR) ..... 10-2014-0177805

(51) Int. Cl.
*F01L 1/34* (2006.01)
*F01L 13/00* (2006.01)

(52) U.S. Cl.
CPC ... *F01L 13/0015* (2013.01); *F01L 2013/0084* (2013.01)

(58) Field of Classification Search
CPC ..... F01L 13/0015; F01L 2013/0084
USPC ..... 123/90.16, 90.17
See application file for complete search history.

(56) References Cited

U.S. PATENT DOCUMENTS

| | | | | |
|---|---|---|---|---|
| 5,924,334 | A | 7/1999 | Hara et al. | |
| 7,721,691 | B2 | 5/2010 | Tateno | |
| 2013/0146006 | A1* | 6/2013 | Kim | F01L 1/0532 123/90.17 |

FOREIGN PATENT DOCUMENTS

| | | | |
|---|---|---|---|
| EP | 2 322 771 | A1 | 5/2011 |
| JP | 6-185321 | A | 7/1994 |
| JP | 5582195 | B2 | 9/2014 |
| KR | 10-2013-0063819 | A | 6/2013 |
| KR | 10-1326818 | B1 | 11/2013 |

* cited by examiner

*Primary Examiner* — Zelalem Eshete
(74) *Attorney, Agent, or Firm* — Morgan, Lewis & Bockius LLP

(57) ABSTRACT

A continuous variable valve duration apparatus may include a camshaft, first and second cam portions, of which the camshaft is inserted thereto, of which relative phase angles with respect to the camshaft are variable, a first and a second inner brackets transmitting rotation of the camshaft to the first and second cam portions respectively, a slider housing of which the first and second inner brackets are rotatably inserted thereto, of which relative position with respect to the camshaft is variable and of which a guide protruded portion is formed to an upper side thereof, cam caps of which each cam cap engaging portion is rotatably connected thereto, a connecting bracket connecting the cam caps and of which a guide slot for the guide protruded portion to be inserted thereto is formed thereto and a control portion selectively changing a position of the slider housing.

16 Claims, 8 Drawing Sheets

CONTINUOUS VARIABLE VALVE DURATION APPARATUS AND ENGINE PROVIDED WITH THE SAME

CROSS-REFERENCE TO RELATED APPLICATION

The present application claims priority to and the benefit of Korean Patent Application No. 10-2014-0177805 filed on Dec. 10, 2014, the entire contents of which is incorporated herein for all purposes by this reference.

BACKGROUND OF THE INVENTION

Field of the Invention

The present invention relates to a continuous variable valve duration apparatus and an engine provided with the same. More particularly, the present invention relates to a continuous variable valve duration apparatus an engine provided with the same which may vary opening duration of a valve according to operation conditions of an engine with a simple construction.

Description of Related Art

An internal combustion engine generates power by burning fuel in a combustion chamber in an air media drawn into the chamber. Intake valves are operated by a camshaft in order to intake the air, and the air is drawn into the combustion chamber while the intake valves are open. In addition, exhaust valves are operated by the camshaft, and a combustion gas is exhausted from the combustion chamber while the exhaust valves are open.

Optimal operation of the intake valves and the exhaust valves depends on a rotation speed of the engine. That is, an optimal lift or optimal opening/closing timing of the valves depends on the rotation speed of the engine. In order to achieve such optimal valve operation depending on the rotation speed of the engine, various researches, such as designing of a plurality of cams and a continuous variable valve lift (CVVL) that can change valve lift according to engine speed, have been undertaken.

Also, in order to achieve such an optimal valve operation depending on the rotation speed of the engine, research has been undertaken on a continuously variable valve timing (CVVT) apparatus that enables different valve timing operations depending on the engine speed. The general CVVT may change valve timing with a fixed valve opening duration.

However, the general CVVL and CVVT are complicated in construction and are expensive in manufacturing cost.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY

Various aspects of the present invention are directly providing a continuous variable valve duration apparatus and an engine provided with the same which may vary opening duration of a valve according to operation conditions of an engine, with a simple construction.

According to various aspects of the present invention, a continuous variable valve duration apparatus may include a camshaft, a first and a second cam portions of which two cams are formed thereto respectively, of which the camshaft is inserted thereto, of which relative phase angles with respect to the camshaft are variable, disposed on one cylinder and the next cylinder respectively, and of which a cam cap engaging portion is formed between the cams respectively, a first and a second inner brackets transmitting rotation of the camshaft to the first and second cam portions respectively, a slider housing of which the first and second inner brackets are rotatably inserted thereto, of which relative position with respect to the camshaft is variable and of which a guide protruded portion is formed to an upper side thereof, cam caps of which each cam cap engaging portion is rotatably connected thereto, a connecting bracket connecting the cam caps and of which a guide slot for the guide protruded portion to be inserted thereto for guiding movement of the slider housing is formed thereto and a control portion selectively changing a position of the slider housing.

A first and a second sliding holes may be formed to the first and second inner brackets respectively, a slider pin inserted into the camshaft may be rotatably inserted into the first sliding hole, a cam key may be formed to the first and second cam portions respectively and a cam pin of which a cam key slot for the cam key to be slidably inserted thereto is formed thereto may be slidably inserted into the second sliding hole respectively.

The slider pin may include a pin body connected to the camshaft and a pin head connected with the pin body and rotatably inserted into the first sliding hole.

The continuous variable valve duration apparatus may further include a double row bearing disposed within the slider housing and connected with the first and second inner brackets.

A control slot may be formed to the slider housing, and the control portion may include an eccentric control shaft inserted into the control slot, a worm wheel connected with the eccentric control shaft, a worm gear engaged with the worm wheel and a control motor selectively rotating the worm gear for changing relative a position of the sliding housing.

A shaft hole where the eccentric control shaft is inserted thereto may be formed between the connecting bracket and the each cam cap.

The first and second cam portions may be disposed as a plural and the slider housing may be disposed at least two, and the one control portion may change the relative positions of the each slider housing.

A first and a second sliding holes may be formed to the each first and second inner brackets respectively, a slider pin inserted into the camshaft may be rotatably inserted into the first sliding hole respectively, a cam key may be formed to the first and second cam portions respectively and a cam pin of which a cam key slot for the cam key to be slidably inserted thereto is formed thereto may be slidably inserted into the second sliding hole respectively.

The slider pin may include a pin body connected to the camshaft and a pin head connected with the pin body and rotatably inserted into the first sliding hole.

The continuous variable valve duration apparatus may further include a double row bearing disposed within the each slider housing and connected with the first and second inner brackets.

A control slot may be formed to the slider housing, and the control portion may include one eccentric control shaft inserted into the control slot, one worm wheel connected with the eccentric control shaft, one worm gear engaged with the worm wheel and one control motor selectively rotating the worm gear for changing relative positions of the sliding housings.

A shaft hole where the eccentric control shaft is inserted thereto may be formed between the connecting brackets and the each cam cap respectively.

According to various aspects of the present invention, an engine may include a camshaft, at least two of a first and a second cam portions of which two cams are formed thereto respectively, of which the camshaft is inserted thereto, of which relative phase angles with respect to the camshaft are variable, disposed on one cylinder and the next cylinder respectively, and of which a cam cap engaging portion is formed between the cams respectively, first and second inner brackets transmitting rotation of the camshaft to the first and second cam portions respectively, at least two of slider housings of which the first and second inner brackets are rotatably inserted thereto, of which relative positions with respect to the camshaft is variable and of which a guide protruded portion is formed to an upper side thereof respectively, at least four of cam caps of which each cam cap engaging portion is rotatably connected thereto, connecting brackets connecting the cam caps and of which a guide slot for the guide protruded portion to be inserted thereto for guiding movement of the slider housing is formed thereto respectively and a control portion selectively changing a position of the slider housing.

A first and a second sliding holes may be formed to the first and second inner brackets respectively, a slider pin inserted into the camshaft is rotatably inserted into the first sliding hole respectively, a cam key may be formed to the first and second cam portions respectively and a cam pin of which a cam key slot for the cam key to be slidably inserted thereto is formed thereto may be slidably inserted into the second sliding hole respectively.

The slider pin may include a pin body connected to the camshaft and a pin head connected with the pin body and rotatably inserted into the first sliding hole.

The engine may further include a double row bearing disposed within the slider housing respectively and connected with the first and second inner brackets respectively.

A control slot may be formed to the each slider housing, and the control portion may include one eccentric control shaft inserted into the control slot, one worm wheel connected with the eccentric control shaft, one worm gear engaged with the worm wheel and one control motor selectively rotating the worm gear for changing relative positions of the sliding housings.

A shaft hole where the eccentric control shaft is inserted thereto may be formed between the each connecting brackets and the each cam cap.

As described above, a continuous variable valve duration apparatus according to an exemplary embodiment of the present invention may vary an opening duration of a valve according to operation conditions of an engine, with a simple construction.

The continuous variable valve duration apparatus according to an exemplary embodiment of the present invention may be reduced in size and thus the entire height of a valve train may be reduced.

Since the continuous variable valve duration apparatus may be applied to an existing engine without excessive modification, thus productivity may be enhance and production cost may be reduced.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
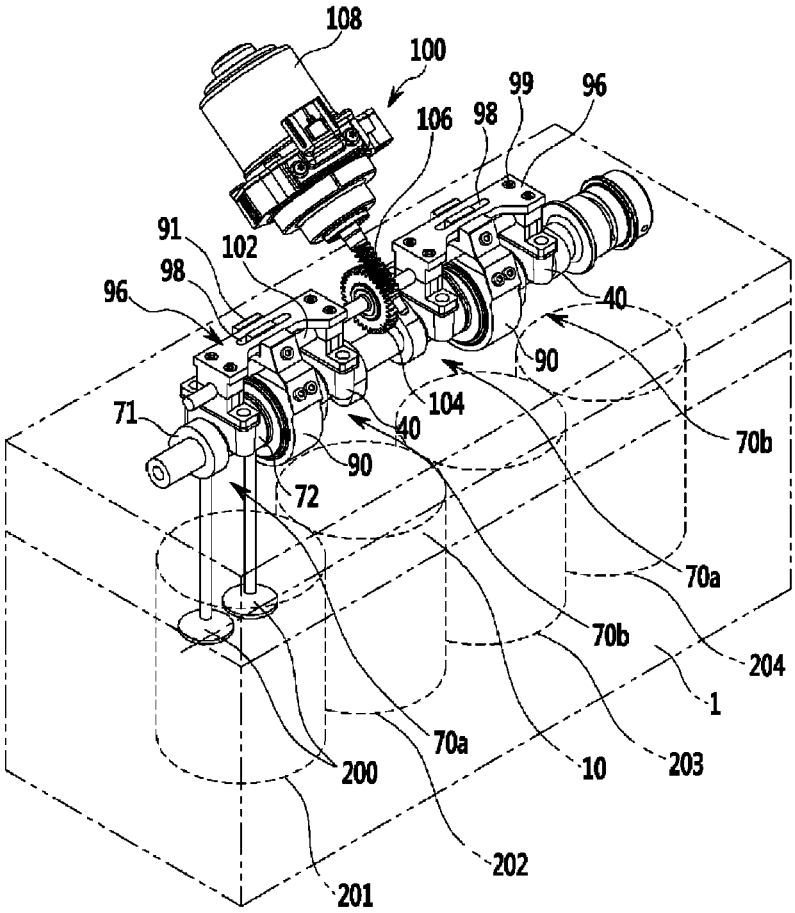
FIG. 1 is a perspective view of an engine provided with a continuous variable valve duration apparatus according to an exemplary embodiment of the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

In the following detailed description, only certain exemplary embodiments of the present invention have been shown and described, simply by way of illustration.

As those skilled in the art would realize, the described embodiments may be modified in various different ways, all without departing from the spirit or scope of the present invention A part irrelevant to the description will be omitted to clearly describe the present invention, and the same or similar elements will be designated by the same reference numerals throughout the specification.

In the drawings, the thickness of layers, films, panels, regions, etc., are exaggerated for clarity.

Throughout the specification and the claims, unless explicitly described to the contrary, the word "comprise" and variations such as "comprises" or "comprising", will be understood to imply the inclusion of stated elements but not the exclusion of any other elements.

An exemplary embodiment of the present invention will hereinafter be described in detail with reference to the accompanying drawings.

Figure 2:
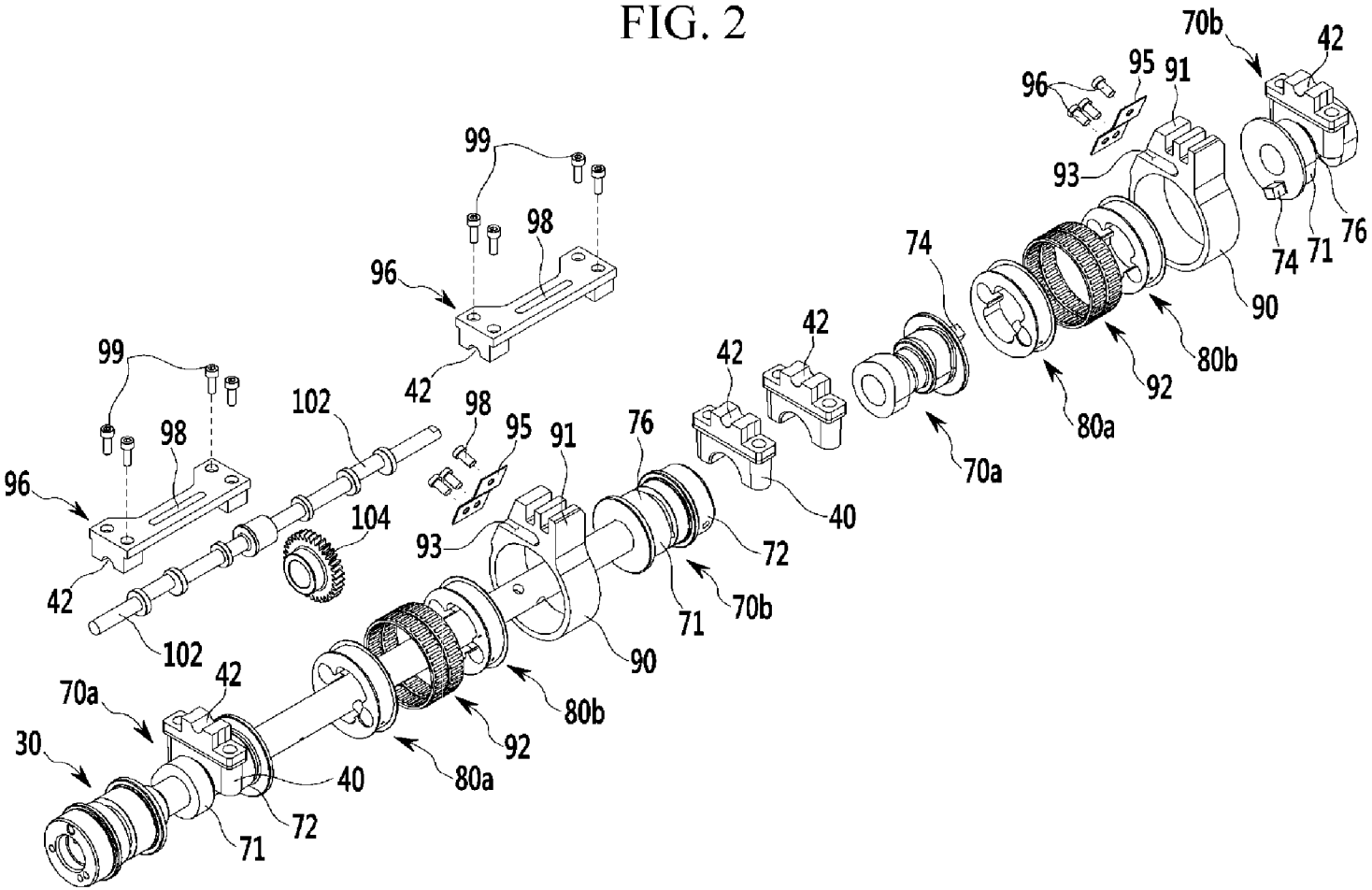
FIG. 2 is an exploded perspective view of a continuous variable valve duration apparatus according to an exemplary embodiment of the present invention.
Figure 3:
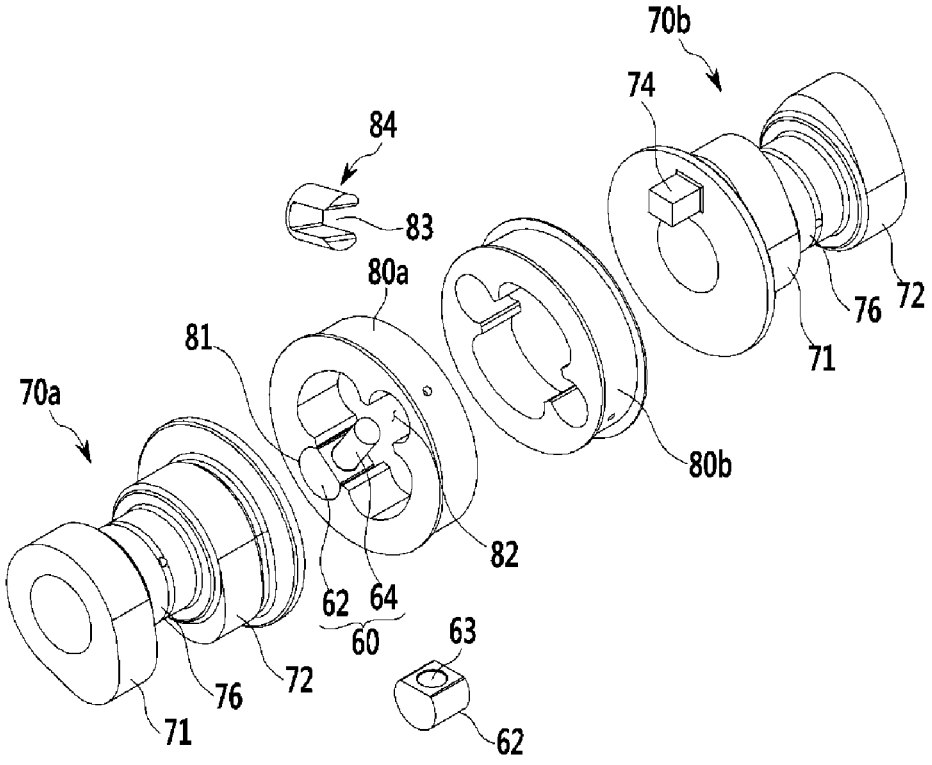
FIG. 3 is a partial exploded perspective view of a continuous variable valve duration apparatus according to an exemplary embodiment of the present invention.

FIG. 1 is a perspective view of an engine provided with a continuous variable valve duration apparatus according to an exemplary embodiment of the present invention, FIG. 2 is an exploded perspective view of a continuous variable valve duration apparatus according to an exemplary embodiment of the present invention, and FIG. 3 is a partial exploded perspective view of a continuous variable valve duration apparatus according to an exemplary embodiment of the present invention.

Referring to FIG. 1 to FIG. 3, an engine according to an exemplary embodiment of the present invention includes an engine block 1, and a cylinder head 10 disposed on the engine block 1 and a continuous variable valve duration apparatus mounted to the cylinder head 10.

In the drawings, the engine includes 4 cylinders 201, 202, 203 and 204, but is not limited thereto.

The continuous variable valve duration apparatus include a camshaft 30, a first and a second cam portions 70*a* and 70*b* of which two cams 71 and 72 are formed thereto respectively, of which the camshaft 30 is inserted thereto, of which relative phase angles with respect to the camshaft 30 are variable, disposed on one cylinder and the next cylinder respectively, and of which a cam cap engaging portion 76 is formed between the cams respectively, a first and a second inner brackets 80*a* and 80*b* transmitting rotation of the camshaft 30 to the first and second cam portions 70*a* and 70*b* respectively, a slider housing 90 of which the first and second inner brackets 80*a* and 80*b* are rotatably inserted thereto, of which relative position with respect to the camshaft 30 is variable and of which a guide protruded portion 91 is formed to an upper side thereof, cam caps 40 of which each cam cap engaging portion 76 is rotatably connected thereto, a connecting bracket 96 connecting the cam caps 40 and of which a guide slot 98 for the guide protruded portion 91 to be inserted thereto for guiding movement of the slider housing 90 is formed thereto and a control portion 100 selectively changing a position of the slider housing 90.

The camshaft 30 may be an intake camshaft or an exhaust camshaft.

The cams 71 and 72 contact to open valve 200.

A first and a second sliding holes 81 and 82 are formed to the first and second inner brackets 80*a* and 80*b* respectively, a slider pin 60 connected with the camshaft 30 is rotatably inserted into the first sliding hole 81, a cam key 74 is formed to the first and second cam portions 70*a* and 70*b* respectively and a cam pin 84 of which a cam key slot 83 for the cam key 74 to be slidably inserted thereto is formed thereto is slidably inserted into the second sliding hole 82.

The slider pin 60 includes a pin body 62 connected to the camshaft 30 and a pin head 64 slidably connected with the pin body 62 and rotatably inserted into the first sliding hole 81. A slider pin hole 61 is formed to the pin head 64 and the pin body 62 is slidably inserted into the slider pin hole 61.

A double row bearing 92 is disposed within the slider housing 90 and is connected with the first and second inner brackets 80*a* and 80*b*. Thus, the first and second inner bracket 80*a* and 80*b* are disposed within one slider housing 90 and may be rotated without interruption due to the double row bearing 92.

Also, since the first and second inner brackets 80*a* and 80*b* are disposed within one slider housing 90, thus numbers of elements may be reduce, productivity may be improved and space for accommodating the continuous variable valve duration apparatus may be reduced.

A control slot 93 is formed to the slider housing 90, and the control portion 100 includes an eccentric control shaft 102 inserted into the control slot, and a control motor 108 selectively rotating the eccentric control shaft 102 in order to change the relative position of the sliding housing 90. A worm wheel 104 is connected to the eccentric control shaft 102 and a worm gear 106 is connected to the control motor 108 and engaged with the worm wheel 104.

A slot cover 95 connected with the slider housing 90 through bolts 98 for preventing for the eccentric control shaft 102 from moving away from the control slot 93.

The each cam cap 40 is connected with the connecting bracket 96 through bolts 99 and a shaft hole 42 where the eccentric control shaft 102 is inserted thereto is formed between the cam cap 40 and the connecting bracket 96 respectively. Since the eccentric control shaft 102 is inserted into the shaft hole 42, the eccentric control shaft 102 may be stably supported.

As shown in FIG. 1 to FIG. 4, the continuous variable valve duration apparatus according to various exemplary embodiments of the present invention may be applied to an engine with four cylinders, but is not limited thereto. The continuous variable valve duration apparatus according to various exemplary embodiments of the present invention may be applied to an engine with various cylinders, for example with six or more cylinders.

For easy comprehension, the continuous variable valve duration apparatus which is applied to a four-cylinder engine will be discussed.

The continuous variable valve duration apparatus may include a plurality of the first and second cam portions 70*a* and 70*b*, at least of the slider housings 90 may be disposed, and one control portion 100 changes the relative positions of the each slider housing 90.

The connecting bracket 96 may be connected with two cam caps 40 respectively, and one slider housing 90 may be guided by the guide slot 98 of the connecting bracket 96.

Since the structure and functions of the inner brackets 80, the double row bearing 92 and so on are the same as described above, thus repeated explanation will be omitted.

Figure 4:
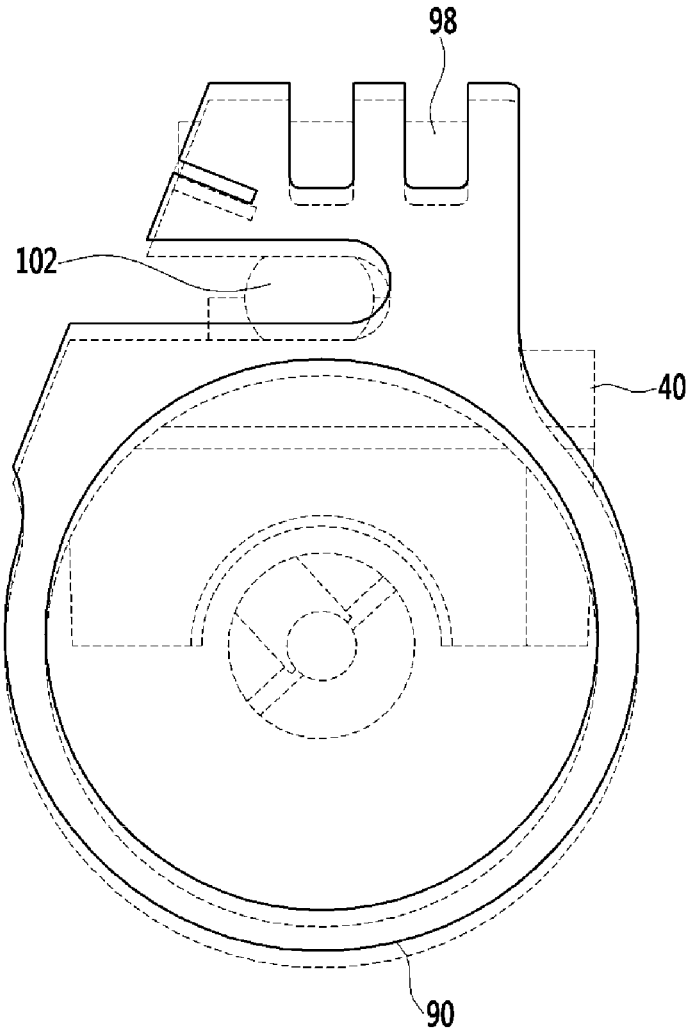
FIG. 4 and FIG. 5 are drawings showing operation of a continuous variable valve duration apparatus according to an exemplary embodiment of the present invention.
Figure 5:
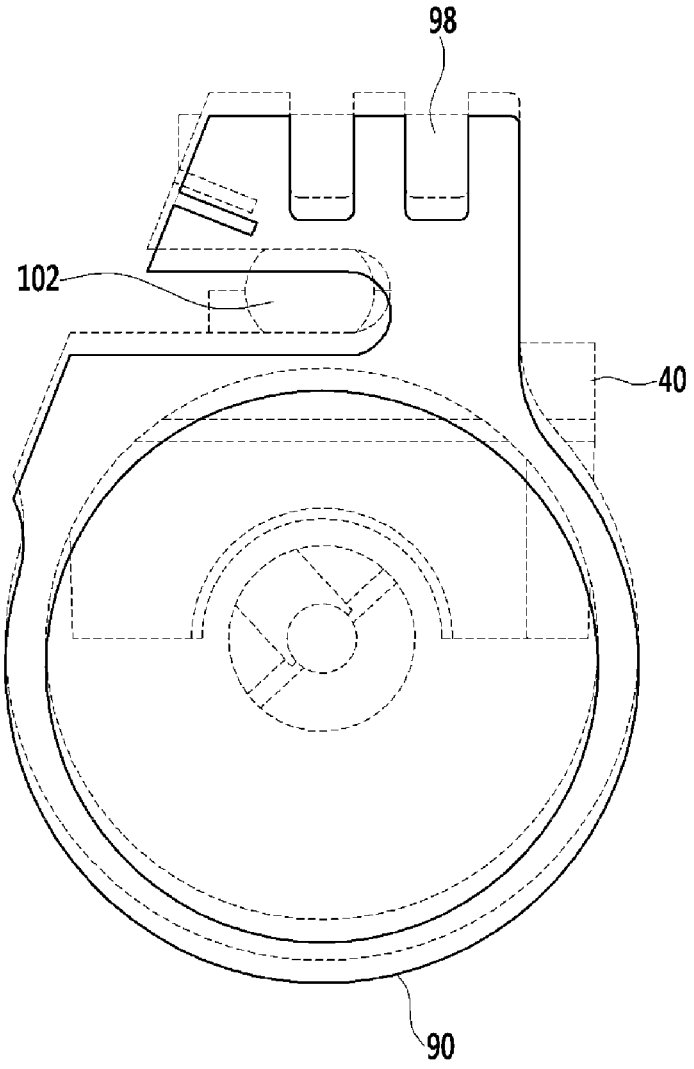
Figure 6:
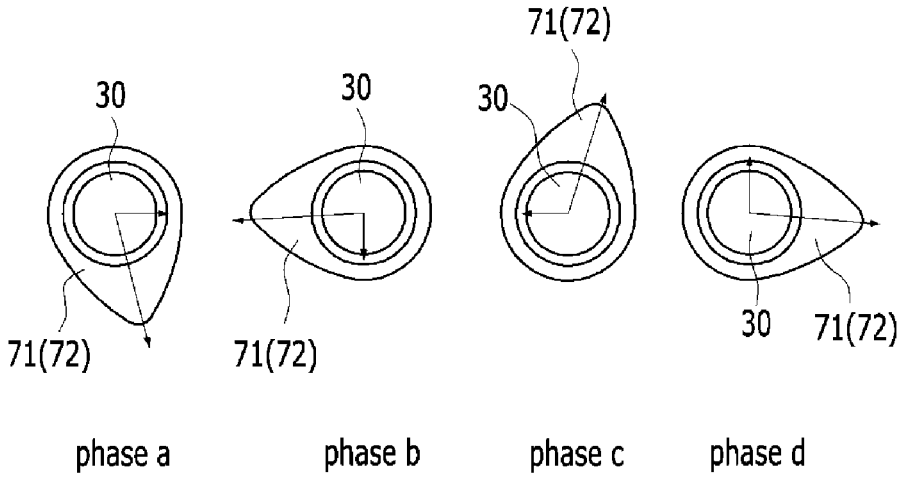
FIG. 6 and FIG. 7 are drawings showing mechanical motions of cams of a continuous variable valve duration apparatus according to an exemplary embodiment of the present invention.
Figure 7:
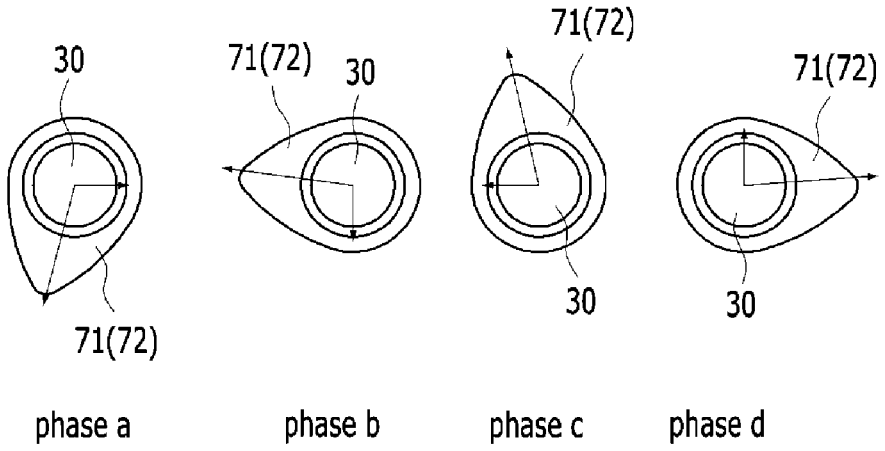

FIG. 4 and FIG. 5 are a drawings showing operation of a continuous variable valve duration apparatus according to an exemplary embodiment of the present invention, and FIG. 6 and FIG. 7 are drawings showing mechanical motions of cams of a continuous variable valve duration apparatus according to an exemplary embodiment of the present invention.

Referring to FIG. 1 to FIG. 7, operations of the continuous variable valve duration apparatus according to various exemplary embodiments of the present invention will be described.

According to engine operation states, an ECU (engine control unit or electric control unit) transmits control signals to the motor 108 of the control portion 100 to change the relative position of the slider housing 90.

For example, as shown in FIG. 4 when the motor 108 rotates the eccentric control shaft 102 for the slider housing 90 to be moved, the rotation center of the inner bracket 80 moves upward with respect to the rotation center of the camshaft 30.

Dotted lines in the drawing indicate neutral state of which rotation centers of the camshaft 30 and the inner bracket 80 are the same and duration change and phase change are not occurred.

As shown in FIG. 5, when the motor 108 rotates the eccentric control shaft 102 for the slider housing 90 to be moved, the rotation center of the inner bracket 80 moves downward with respect to the rotation center of the camshaft 30.

Similar to the FIG. 4 dotted lines in the drawing indicate neutral state of which rotation centers of the camshaft 30 and the inner bracket 80 are the same and duration change and phase change are not occurred.

As shown in FIG. 4 and FIG. 5, when the control motor 108 rotates, the relative positions of the slider housing 90 and the inner bracket 80 with respect to the position of the camshaft 30 are changed As shown in FIG. 6, while the phase angle of the camshaft 30 is constantly changed when the relative rotation center of the cams 71 and 72 with respect to the rotation center of the camshaft 30 is changed downward, the rotation speed of the cams 71 and 72 is relatively faster than rotation speed of the camshaft 30 from phase a to phase b and from phase b to phase c, then the rotation speed of the cams 71 and 72 is relatively slower than rotation speed of the camshaft 30 from phase c to phase d and from phase d to phase a. That is, the valve duration is changed.

As shown in FIG. 7, while the phase angle of the camshaft 30 is constantly changed when the relative rotation center of the cams 71 and 72 with respect to the rotation center of the camshaft 30 is changed upward, the rotation speed of the cams 71 and 72 is relatively slower than rotation speed of the camshaft 30 from phase a to phase b and from phase b to phase c, then the rotation speed of the cams 71 and 72 is relatively faster than rotation speed of the camshaft 30 from phase c to phase d and from phase d to phase a. That is, the valve duration is changed.

While the slider pin 60 is rotated together with the camshaft 30, the pin body 62 is slidable with respect to the pin head 64, the pin head 64 is rotatably inserted into the first sliding hole 81, the cam pin 84 is rotatably inserted into the second sliding hole 82, and the cam key 74 is slidable within the cam key slot 83. Thus, when the relative rotation centers of the inner bracket 80 and the camshaft 30 are changed, the relative rotation speed of the cams 71 and 72 with respect to the rotation speed of the camshaft 30 is changed.

Figure 8:
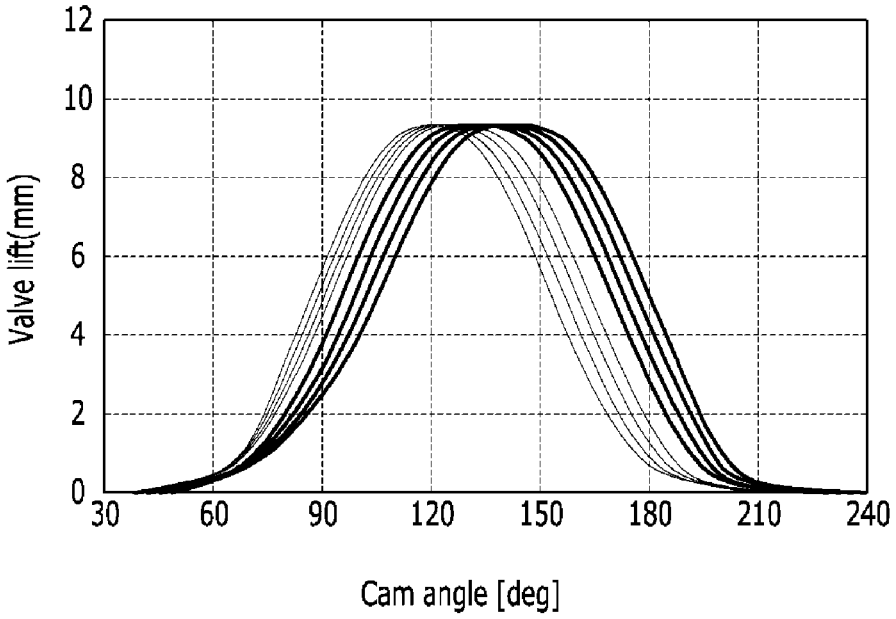
FIG. 8 is a graph of a valve profile of a continuous variable valve duration apparatus according to an exemplary embodiment of the present invention.

That is, as shown in FIG. 8, although maximum lift of the valve 200 is constant, however rotation speed of the cam 71 and 72 with respect to the rotation speed of the camshaft 30 is changed according to relative positions of the slider housing 90 so that closing and opening time of the valve 200 is changed. That is, duration of the valve 200 is changed.

While opening time of the valve 200 is constant, closing time of the valve 200 is changed in FIG. 8, it is not limited thereto. According to various mounting angle of the cams 71 and 72 and the valve 200, various contacting angles between cam lobe of the cams 71 and 72 and the valve 200 and so on, various valve duration may be performed.

Determinations of the control signals of the ECU according to the engine operation state is obvious to a person skilled in the art, thus detailed description will be omitted. As described above, a continuous variable valve duration apparatus according to an exemplary embodiment of the present invention may vary an opening duration of a valve according to operation conditions of an engine, with a simple construction.

The continuous variable valve duration apparatus according to an exemplary embodiment of the present invention may be reduced in size and thus the entire height of a valve train may be reduced.

Since the continuous variable valve duration apparatus may be applied to an existing engine without excessive modification, thus productivity may be enhance and production cost may be reduced.

For convenience in explanation and accurate definition in the appended claims, the terms "upper", "lower", "inner" and "outer" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A continuous variable valve duration apparatus comprising:

a camshaft;

a first cam portion and a second cam portion of which two cams are formed thereto respectively, of which the camshaft is inserted thereto, of which relative phase angles with respect to the camshaft are variable, disposed on one cylinder and the next cylinder respectively, and of which a cam cap engaging portion is formed between the cams respectively;

a first inner bracket and a second inner bracket transmitting rotation of the camshaft to the first and second cam portions respectively;

a slider housing of which the first and second inner brackets are rotatably inserted thereto, of which relative position with respect to the camshaft is variable and of which a guide protruded portion is formed to an upper side thereof;

cam caps of which each cam cap engaging portion is rotatably connected thereto;

a connecting bracket connecting the cam caps and of which a guide slot for the guide protruded portion to be inserted thereto for guiding movement of the slider housing is formed thereto; and a control portion selectively changing a position of the slider housing, wherein a first sliding hole and a second sliding hole are formed to the first and second inner brackets respectively;

wherein a slider pin inserted into the camshaft is rotatably inserted into the first sliding hole;

wherein a cam key is formed to the first and second cam portions respectively; and wherein a cam pin of which a cam key slot for the cam key to be slidably inserted thereto is formed thereto is slidably inserted into the second sliding hole respectively.

2. The continuous variable valve duration apparatus of claim 1, wherein the slider pin comprises:

a pin body connected to the camshaft; and a pin head connected with the pin body and rotatably inserted into the first sliding hole.

3. The continuous variable valve duration apparatus of claim 1, further comprising a double row bearing disposed within the slider housing and connected with the first and second inner brackets.

4. The continuous variable valve duration apparatus of claim 1, wherein a control slot is formed to the slider housing, and the control portion comprises:

an eccentric control shaft inserted into the control slot;

a worm wheel connected with the eccentric control shaft;

a worm gear engaged with the worm wheel; and a control motor selectively rotating the worm gear for changing relative a position of the sliding housing.

5. The continuous variable valve duration apparatus of claim 4, wherein a shaft hole where the eccentric control shaft is inserted thereto is formed between the connecting bracket and the each cam cap.

6. The continuous variable valve duration apparatus of claim 1, wherein the first and second cam portions are disposed as a plural; and the slider housing is disposed at least two, wherein the one control portion changes the relative positions of the each slider housing.

7. The continuous variable valve duration apparatus of claim 6, wherein a first sliding hole and a second sliding hole are formed to the each first and second inner brackets respectively;

a slider pin inserted into the camshaft is rotatably inserted into the first sliding hole respectively;

a cam key is formed to the first and second cam portions respectively; and a cam pin of which a cam key slot for the cam key to be slidably inserted thereto is formed thereto is slidably inserted into the second sliding hole respectively.

8. The continuous variable valve duration apparatus of claim 7, wherein the slider pin comprises:

a pin body connected to the camshaft; and a pin head connected with the pin body and rotatably inserted into the first sliding hole.

9. The continuous variable valve duration apparatus of claim 7, further comprising a double row bearing disposed within the each slider housing and connected with the first and second inner brackets.

10. The continuous variable valve duration apparatus of claim 1, wherein a control slot is formed to the slider housing, and the control portion comprises:

one eccentric control shaft inserted into the control slot;

one worm wheel connected with the eccentric control shaft;

one worm gear engaged with the worm wheel; and one control motor selectively rotating the worm gear for changing relative positions of the sliding housings.

11. The continuous variable valve duration apparatus of claim 10, wherein a shaft hole where the eccentric control shaft is inserted thereto is formed between the connecting brackets and the each cam cap respectively.

12. An engine comprising:

a camshaft;

at least two of a first cam portion and a second cam portion of which two cams are formed thereto respectively, of which the camshaft is inserted thereto, of which relative phase angles with respect to the camshaft are variable, disposed on one cylinder and the next cylinder respectively, and of which a cam cap engaging portion is formed between the cams respectively;

first and second inner brackets transmitting rotation of the camshaft to the first and second cam portions respectively;

at least two of slider housings of which the first and second inner brackets are rotatably inserted thereto, of which relative positions with respect to the camshaft is variable and of which a guide protruded portion is formed to an upper side thereof respectively;

at least four of cam caps of which each cam cap engaging portion is rotatably connected thereto;

connecting brackets connecting the cam caps and of which a guide slot for the guide protruded portion to be inserted thereto for guiding movement of the slider housing is formed thereto respectively; and a control portion selectively changing a position of the slider housing, wherein a first sliding hole and a second sliding hole are formed to the first and second inner brackets respectively;

wherein a slider pin inserted into the camshaft is rotatably inserted into the first sliding hole respectively;

wherein a cam key is formed to the first and second cam portions respectively; and wherein a cam pin of which a cam key slot for the cam key to be slidably inserted thereto is formed thereto is slidably inserted into the second sliding hole respectively.

13. The engine of claim 12, wherein the slider pin comprises:

a pin body connected to the camshaft; and a pin head connected with the pin body and rotatably inserted into the first sliding hole.

14. The engine of claim 12, further comprising a double row bearing disposed within the slider housing respectively and connected with the first and second inner brackets respectively.

15. The engine of claim 12, wherein a control slot is formed to the each slider housing, and the control portion comprises:

one eccentric control shaft inserted into the control slot;

one worm wheel connected with the eccentric control shaft;

one worm gear engaged with the worm wheel; and one control motor selectively rotating the worm gear for changing relative positions of the sliding housings.

16. The engine of claim 15, wherein a shaft hole where the eccentric control shaft is inserted thereto is formed between the each connecting brackets and the each cam cap.

* * * * *